US005203931A

United States Patent [19]

O'Keefe

[11] Patent Number: 5,203,931

[45] Date of Patent: Apr. 20, 1993

[54] ELECTRODEPOSITION OF INDIUM-THALLIUM SHAPE MEMORY ALLOYS

[75] Inventor: Thomas J. O'Keefe, Columbia, Mo.

[73] Assignee: University of Missouri, Columbia, Mo.

[21] Appl. No.: 763,343

[22] Filed: Sep. 20, 1991

[51] Int. Cl.[5] ..... C25D 3/56; C25D 5/18

[52] U.S. Cl. ..... 148/518; 148/563; 205/104; 205/238

[58] Field of Search ..... 205/104, 238; 148/402, 148/563, 518

[56] References Cited

U.S. PATENT DOCUMENTS

| | | | |
|---|---|---|---|
| 2,458,839 | 1/1949 | Dyer et al. | 204/45 |
| 3,999,790 | 12/1976 | Rogen | 292/201 |
| 4,018,547 | 4/1977 | Rogen | 417/321 |
| 4,225,051 | 9/1980 | Faudou et al. | 220/3 |
| 4,424,865 | 1/1984 | Payton | 148/402 |
| 4,732,556 | 3/1988 | Chiang | 425/405.2 |
| 4,738,610 | 4/1988 | Chiang | 425/405.2 |
| 4,753,689 | 6/1988 | Rizzo et al. | 148/563 |
| 4,797,085 | 1/1989 | Chiang et al. | 425/405.2 |

OTHER PUBLICATIONS

Izuno; Remarkable Shape-Memory Alloys; Electronic Materials, Sep. 1983 pp. 89-93.

Kochegarov et al.; Chemical Abstract 150199p, vol. 74, 1971.

Sklyarenko et al., (4), 139-144 (1961) (Russia) Izvest Vysshkh Ucheb. Zavedenii, Chem. Abstract vol. 56, col. 4509, 1962.

Tsareva et al., 45(3), 680-682, Zh. Prikl. Khim., Chem Abstract vol. 77, 1972, No. 23799w.

Polovov et al., On The Thermodynamics of Face-centered Tetragonal Face-centered Cubic Transitions in Indium Alloys, Sov. Phys. JEPT, 37(3), p. 476 (1973).

*Primary Examiner*—George Wyszomierski

*Attorney, Agent, or Firm*—Senninger, Powers, Leavitt & Roedel

[57] ABSTRACT

A process for preparing an indium-thallium alloy which exhibits shape memory transformation at a temperature greater than that temperature at which shape memory transformation would occur for a thermally prepared alloy of the same composition. The process includes providing an article for use as a cathode, providing an electrolyte which comprises indium and thallium ions, and electrodepositing an indium-thallium alloy having between about 21 and about 35 atomic percent thallium onto the article. A process for preparing an article constructed of an electrodeposited indium-thallium alloy which exhibits shape memory effect. An electrodeposited indium-based shape memory alloy.

14 Claims, 1 Drawing Sheet

ELECTRODEPOSITION OF INDIUM-THALLIUM SHAPE MEMORY ALLOYS

BACKGROUND OF THE INVENTION

The present invention is directed to novel indium-based shape memory alloys, and especially to novel indium-thallium shape memory alloys. The invention is also directed to an electrolytic process for the production of shape memory alloys.

Certain indium-based alloys are known to exhibit a shape memory effect whereby an article constructed of the alloy "remembers" a certain configuration and assumes that configuration when it is within a certain temperature range. Shape memory alloys are characterized by a parent (beta) phase at a higher first temperature and a martensitic phase or structure at a lower second temperature.

An article of a shape memory alloy in the parent phase can be changed to a martensitic structure by bringing the article below a critical temperature or otherwise applying sufficient stress thereto. The article is then deformed into a second shape. The article of the second shape is then heated to a temperature above the critical temperature, the martensitic structure becomes unstable and the alloy reverts to the parent phase. As the alloy structure reverts to the parent phase, the article regains its first shape, that is, the shape the article had initially when it was in the parent phase, prior to quenching and deformation.

Certain alloys comprising indium and thallium have been recognized as exhibiting shape memory effect. Rogen, U.S. Pat. No. 3,999,790, discloses a heat releasable lock which may be constructed of indium-thallium-nickel-aluminide shape memory alloy. Rogen, U.S. Pat. No. 4,018,547, discloses an oil well pump which may comprise an indium-thallium shape memory component. Chiang et al., U.S. Pat. Nos. 4,732,556, 4,738,610 and 4,797,085, disclose an apparatus comprising a shape memory alloy die which may be constructed of indium-thallium.

Indium-thallium alloys may be produced by thermal methods or by electrolytic methods. Although each alloy production technique has its own advantages which may be specifically desirable for certain applications, electrolytic techniques are suitable for high volume manufacture, provide ease of process control, can be used for thin film applications including microelectronics, and require a relatively low amount of investment in equipment and set up.

In applications where it is desirable to have shape memory alloy material on remote interior surfaces, it may be difficult or impossible to locate thermally prepared shape memory alloy material at these sites. By electrodeposition, it is possible to deposit thin films of material onto such remote interior surfaces of substrates. Additionally, electrolytic methods are generally more suitable than thermal techniques for the production of alloys in thin cross section.

SUMMARY OF THE INVENTION

Accordingly, it is an object of the present invention to provide a process for the electrolytic production of alloys which exhibit shape memory effect; it is a further object of the present invention to provide a process for the electrolytic production of indium-based alloys which exhibit shape memory effect; to provide a process for the electrolytic production of indium-thallium alloys which exhibit shape memory effect; to provide such a process which is adaptable for high volume manufacture; to provide such a process which is capable of producing alloys having a non-equilibrium phase structure; to provide such a process which requires a relatively low amount of investment in equipment and set up; to provide such a process which is especially suited for the production of indium-thallium alloys for use in microelectronic applications; to provide a process suitable for the deposition of shape memory alloys onto remote and interior surfaces of substrates; to provide a process for the production of shape memory alloys in thin cross section; to provide a process characterized by a high degree of process control for the production of shape memory alloys; to provide a process for providing articles constructed of indium-thallium shape memory alloys; to provide indium-based shape memory alloys; to provide indium-thallium shape memory alloys; to provide indium-cadmium shape memory alloys.

Briefly, therefore, the present invention is directed to a process for preparing an indium-thallium alloy which exhibits shape memory transformation at a temperature greater than that temperature at which shape memory transformation would occur for a thermally prepared alloy of the same composition. The process comprises the steps of providing an article for use as a cathode, providing an electrolyte which comprises indium and thallium ions, and electrodepositing an indium-thallium alloy comprising between about 21 and about 35 atomic percent thallium onto the article.

The invention is also directed to a process for preparing an article constructed of an electrodeposited indium-thallium alloy which exhibits shape memory effect. The process comprises the steps of providing an electrodeposited indium-thallium alloy having between about 21 and about 35 atomic percent thallium, establishing a first configuration of the article at a first higher temperature which is greater than the martensitic transformation temperature for the alloy, and establishing a second configuration by deforming the article at a second lower temperature which is less than the martensitic transformation temperature for the alloy.

The invention is also directed to an electrodeposited indium-based alloy exhibiting shape memory transformation, the alloy consisting essentially of indium and an alloying element selected from the group of alloying elements consisting of thallium and cadmium. The alloy has a shape memory transformation temperature different than the shape memory transformation temperature for a thermally prepared alloy of the same composition.

DETAILED DESCRIPTION

Figure 1:
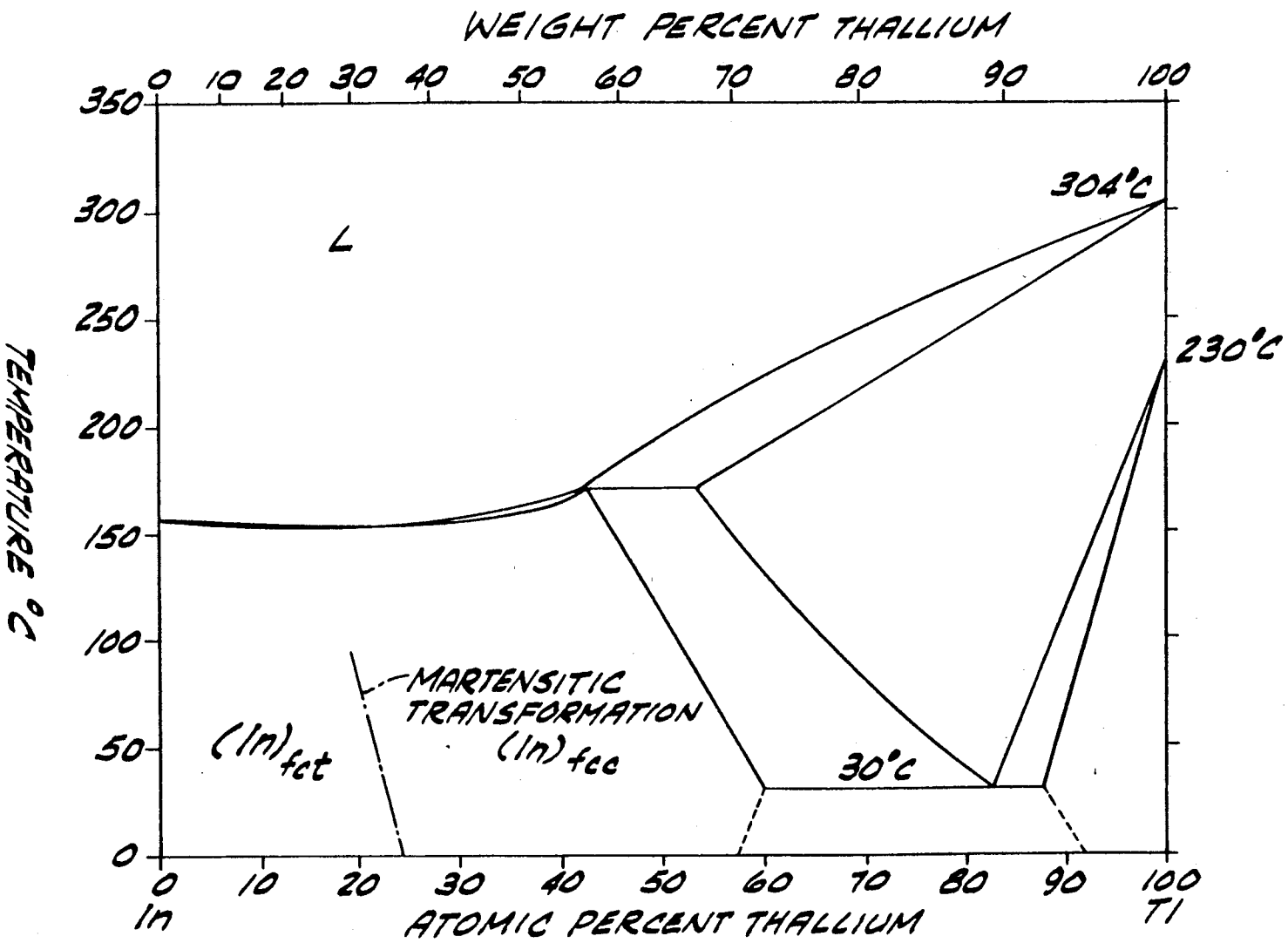
FIG. 1 shows a phase diagram for binary indium-thallium alloys.

The present invention is directed to novel indium-based shape memory alloys. The alloys of the invention include electrodeposited indium-thallium shape memory alloys which have greater than about 20 at.% thallium and which undergo martensitic transformation at a temperature greater than that which would be expected upon examination of the equilibrium phase diagram. The alloys of the invention also include electrodeposited indium-cadmium shape memory alloys which have less than about 7 at.% cadmium and which undergo martensitic transformation at a temperature less than that which would be expected upon examination of the equilibrium phase diagram. The invention is also directed to a novel electrolytic process for producing shape memory alloys.

The equilibrium phase diagram of FIG. 1 illustrates the expected martensitic transformation temperature, i.e., that temperature at which the alloy structure changes from face-centered tetragonal (FCT) to face-centered cubic (FCC). This is the temperature at which shape memory effect is observed for various indium-thallium alloys produced by thermal methods. FIG. 1 indicates that, for thermally prepared alloys, only those indium-thallium alloys having a thallium content between about 18 and about 23 at.% would exhibit shape memory transformation at temperatures above 25° C. However, the alloys of the invention which exhibit shape memory transformation at above 25° C. have thallium contents between about 21 and about 28 at.% . The thallium content of an indium-thallium alloy which exhibits shape memory transformation at a specific temperature is therefore different for thermally produced alloys vis a vis alloys of the invention.

Again referring to the phase diagram of FIG. 1, a thermally produced In-Tl(28 at.%) alloy exhibits an entirely FCC structure over the entire temperature range from 25° C. to 140° C. However, the In-Tl(28 at%) alloy of the invention electrodeposited at 25° C. has a mixed FCT and FCC structure, with only about 24% FCC at 25° C. and about 94% FCC at 140° C. I is thought that the electrodeposition temperature may effect the initial proportion of phases in the alloy upon formation.

A thermally produced In-Tl(24 at.%) alloy exhibits an FCC structure at 25° C. and above. The In-Tl(24 at.%) alloy of the invention electrodeposited at 25° C., however, unexpectedly has an all FCT structure at 25° C. and a mixed FCT and FCC structure at 140° C.

A thermally produced In-Tl(21 at.%) alloy exhibits an all FCT structure at 25° C. and all FCC structure above about 65° C. However, the In-Tl(21 at%) alloy of the invention electrodeposited at 25° C. has an all FCT structure at 25° C. as expected, but has a mixed FCT and FCC structure, with only about 63% FCC, at 140° C.

A thermally produced In Tl(20 at.%) alloy exhibits an all FCT structure at 25° C. and all FCC structure above about 80° C. However, the In-Tl(20 at%) alloy of the invention electrodeposited at 25° C. has an all FCT structure at 25° C. as expected, but still has an all FCT structure at 140° C.

The In-Tl(15 at.%) alloy of the invention electrodeposited at 25° C. has an all FCT structure throughout the temperature range of 25° C. to 140° C. as would be expected from the phase diagram of FIG. 1.

The In-Tl(38 at.%) alloy of the invention electrodeposited at 25° C. has an all FCC structure throughout the temperature range as would be expected according to the equilibrium phase diagram of FIG. 1.

Certain indium-thallium alloys of a given thallium content will exhibit martensitic transformation at a higher temperature if processed according to the method of this invention than if processed thermally. Also, certain alloys, for example, In-Tl(20 at.%), which exhibit shape memory effect if processed by thermal methods, will not exhibit shape memory effect if processed by the method of the invention. Other alloys, for example, In-Tl(28 at.%), which do not exhibit shape memory transformation above 0° C. if processed thermally, will exhibit shape memory effect above 0° C. if processed according to this invention. By processing certain alloys according to the method of the invention, therefore, the martensitic transformation curve is shifted to the right vis a vis its position on the equilibrium phase diagram of FIG. 1.

Which alloy of the invention is preferred will depend on what are the most appropriate martensitic transformation temperature and alloy composition for the particular application. For transformation temperatures between about 0° C. and about 140° C., indium-thallium alloys having between about 21 and about 32 at.% thallium are preferred. For transformation temperatures less than 0° C., indium-thallium alloys having between about 28 and about 35 at.% thallium are preferred.

The difference between the martensitic transformation temperature of thermal alloys and alloys of the invention may be due in part to a greater degree of tetragonality observed in alloys of the invention. The c/a ratio, representing the ratio of lattice parameter length in the tetragonal direction versus that in a cubic direction, has been determined by x-ray diffraction to be greater for alloys of the invention than for thermal alloys. The higher martensitic transformation temperatures for alloys of the invention may in part be explained by a greater amount of energy required to transform, to cubic, the lattices having greater tetragonality.

Another feature of shape memory alloys of the invention is that the temperature interval corresponding to complete Phase transformation is greater than it is for thermally processed indium-thallium alloys. The alloys of the invention, therefore, apparently undergo martensitic transformation differently than would be expected. For example, the In-Tl(21 at%), In-Tl(24 at.%) and In-Tl(28 at.%) alloys do not undergo complete martensitic transformation, that is, less than 100% of the alloy structure transforms from FCT to FCC over the entire temperature range of 25° C. to 140° C. The temperature interval of transformation for thermally processed indium-thallium shape memory alloys, on the other hand, has been reported to be less than 10° C. Polovov et al., *On the Thermodynamics of Face-centered Tetragonal Face-centered Cubic Transitions in Indium Alloys*, Sov. Phys. JEPT, 37(3), p. 476 (1973). For example, an In-Tl(22 at.%) thermally prepared alloy begins to undergo martensitic transformation at about 50° C. and completes transformation at about 55° C.

In accordance with the process of the invention, an electrolytic solution containing indium and thallium or indium and cadmium is provided. The most preferred electrolyte is obtained by dissolving indium sulfate and thallium sulfate in sulfuric acid solution. For example, indium sulfate in the range of from about 30 g/l to about 50 g/l and thallium sulfate in the range of from about 1.0 g/l to about 3.0 g/l is dissolved in a sulfuric acid solution containing between about 20 ml/l and 35 ml/l sulfuric acid. Greater of lesser amounts of indium and thallium sulfate may be required to obtain a deposit of the desired composition as changes in the process parameters affecting efficiency are made. Other sources of indium and thallium are also suitable including indium perchlorate and thallium perchlorate and the like.

A cathode substrate is provided to receive the electrodeposited indium-thallium alloy. The nature of the cathode selected depends in part on the characteristics of the shape memory article to be produced. Where the final article is to be a thin flat article of predetermined dimensions, e.g., 3 $cm^2$, a flat 3 $cm^2$ plate of glassy carbon or other suitable conducting material may serve as the cathode substrate. In the use of such cathodes, the most significant quantity of deposited material is received by one surface lying in a single plane or by two coplanar surfaces. Such cathodes may or may not have a generally rectangular conformation. Cathode materials including titanium, copper, aluminum and graphite, among others, are known in the art and are suitable for this process.

The cathode may also be a multiplanar body such as a generally polyhedral article of manufacture made of a material such as copper which is to receive the shape memory alloy as a permanent plating. By electrodeposition, material can be deposited onto remote surfaces of a multiplanar body which are not readily accessible. When such multiplanar bodies are used as cathodes, two or more surfaces which are not coplanar may receive significant quantities of deposited material. An article used as a cathode may also comprise one or more curved surfaces, and possibly no planar surfaces, which are to receive electrodeposited material. By the use of appropriate masking means known in the art, certain of these surfaces may be selectively protected from deposition. Also, for example, a portion of an electronic circuit may be used as a cathode, with appropriate masking over that portion of the circuit which is not to be plated with the shape memory alloy if desired.

An anode is provided to supply current to the electrolytic bath. The material selected for the anode is not critical to the carrying out of the invention and may be platinum foil or other suitably noble, conducting and oxygen-evolving material known in the art.

The cathode and anode are immersed in the electrolytic bath and pulsed current is passed through the solution between the electrodes resulting in the electrolytic deposition of an alloy of indium-thallium onto the cathode surface. Continuous current may also be used, but pulsed current is preferred because it results in deposits which are smoother, denser and less dendritic.

After the desired thickness is deposited, the supply of current is discontinued and the cathode substrate is removed from the electrolyte. Depending upon the intended use for the shape memory alloy, the article may be ready for use once removed from the electrolyte, or, alternatively, the electrodeposited alloy may be removed from the substrate.

During deposition, the deposition parameters including peak current density, average current density, deposition time, electrolyte temperature, current pulse frequency (on/off time), electrolyte agitation, and total current are carefully controlled.

The peak current density is generally in the range of from about 10 mA/cm$^2$ to about 50 mA/cm$^2$. An increase in peak current density corresponds generally to an increase in the deposition of indium relative to the deposition of thallium. The composition of the electrodeposited binary indium-thallium alloy can therefore be in part controlled by controlling the peak current density. An increase in peak current density, with other parameters held constant, results in an alloy of lower thallium content.

The average current density is generally in the range of from about 3 mA/cm$^2$ to about 35 mA/cm$^2$. An increase in average current density has likewise been found to correspond to an increase in the deposition of indium relative to the deposition of thallium in this binary system. The average current is increased by increasing the peak current density or by increasing the duty cycle (duty cycle = [current on time]/[current on time plus current off time]). The composition of the deposited indium-thallium alloy can therefore be in part controlled by controlling the average current density. An increase in average current density, with other parameters held constant, results in an alloy of lower thallium content.

The alloy composition may also be in part controlled by variation of the pulse frequency of the pulsed current. An increase in off time has been found to correspond to a slight increase in thallium content. This effect is thought to be due in part to the fact that a longer off time provides a greater opportunity for migration of the more noble and generally more preferentially deposited thallium ions to the electrolyte-electrode interface. Additionally, a shorter off time corresponds to an overall increase in average current density which, as discussed above, results in an increase in relative indium deposition. Although on time and off time are not particularly critical parameters, it is preferred that both be maintained in the range of from about 10 msec to about 50 msec, with a duty cycle in the range of from about 30% to about 70%.

The temperature of the electrolytic bath is generally maintained in the range of from about 20° C. to about 50° C. Because an increase in electrolyte temperature increases the rates of convection and diffusion, it is expected to increase metal ion concentration at the electrode-electrolyte interface. An increase in bath temperature, therefore, is thought to increase the relative deposition, and thus the resulting alloy content, of the more noble species of the particular binary system. In the indium-thallium system, thallium is the more noble, preferentially deposited component.

The electrolyte temperature is also thought to effect the proportion of FCC and FCT phases in the alloy as initially deposited. More specifically, the temperature of electrodeposition, and its position relative to the martensitic transformation temperature of the particular alloy, is thought to affect the percentage of alloy which deposits with an FCT structure and the percentage of alloy which deposits with an FCC structure.

The electrodeposition is also affected by the degree of agitation of the electrolytic bath. By facilitating the diffusion of ions to the electrode-electrolyte interface, agitation is thought to increase the relative deposition of the more diffusion-dependent component of binary alloy systems, in this case, thallium. By providing or increasing agitation, therefore, the thallium content of the deposited alloy is generally increased. Likewise, providing agitation would allow one to reduce the starting thallium content of the electrolyte.

The quantity of alloy deposited is precisely controlled by controlling the total amount of current supplied, measured in ampere-hours. Ampere-hours are a function of deposition time, duty cycle, peak current density and average current density. An increase in total current supplied corresponds to an increase in deposit thickness.

The following examples illustrate the invention.

EXAMPLES 1-17

Approximately 250 ml of a synthetic electrolyte having a pH of about 2.0 was prepared by dissolving 40.59 g/l indium sulfate and 2.22 g/l thallium sulfate in a 28 ml/l sulfuric acid solution. A glassy carbon plate with a surface area of 3cm$^2$ on one side was cleaned ultrasonically in a micro-detergent solution, rinsed with deionized water and provided as the cathode. A piece of platinum foil with a one-sided surface area of 4cm$^2$ was provided as the anode. Pulsed current was provided to the electrolyte by a Dynatronix Model DPR 20-1-3 pulse rectifier. The electrolyte was not agitated. For each variation of the process parameters as set forth in Table 1, a deposit which was 50+/−10 microns thick was removed from the cathode by peeling.

TABLE 1

| Ex. # | At. % Tl | Peak Current Density MA/cm$^2$ | On/Off Time MSEC | Duty Cycle % | Total Current amp-hrs | Electrolyte Temperature °C. |
|---|---|---|---|---|---|---|
| 1 | 15.0 | 40.0 | 20/40 | 33.3 | 0.06 | 25 |
| 2 | 16.4 | 40.0 | 20/20 | 50.0 | 0.06 | 45 |
| 3 | 19.3 | 20.0 | 40/40 | 50.0 | 0.06 | 45 |
| 4 | 20.0 | 23.3 | 20/40 | 33.3 | 0.06 | 25 |
| 5 | 21.0 | 30.0 | 20/40 | 33.3 | 0.06 | 25 |
| 6 | 21.5 | 23.3 | 20/40 | 33.3 | 0.06 | 45 |
| 7 | 21.6 | 20.0 | 40/20 | 66.7 | 0.06 | 45 |
| 8 | 24.0 | 16.7 | 20/40 | 33.3 | 0.06 | 25 |
| 9 | 24.2 | 20.0 | 20/20 | 50.0 | 0.06 | 25 |
| 10 | 25.2 | 16.7 | 20/40 | 33.3 | 0.06 | 45 |
| 11 | 28.0 | 10.0 | 20/40 | 33.3 | 0.06 | 25 |
| 12 | 30.0 | 16.7 | 20/40 | 33.3 | 0.06 | 25 |
| 13 | 31.2 | 16.7 | 20/60 | 25.0 | 0.06 | 25 |
| 14 | 31.7 | 23.3 | 2/4 | 33.3 | 0.06 | 25 |
| 15 | 34.5 | 23.3 | 0.2/0.4 | 33.3 | 0.06 | 25 |
| 16 | 38.0 | 6.7 | 20/40 | 33.3 | 0.06 | 25 |
| 17 | 38.8 | 16.7 | 20/40 | 33.3 | 0.06 | 55 |

The alloys prepared as set forth in each of the above examples were tested for shape memory effect. Narrow flat strips of each alloy were heated to a temperature above that temperature at which martensitic transformation was estimated to occur in order to ensure that each alloy attained an at least partially face-centered cubic structure (parent Phase). The temperature corresponding to partial attainment of parent phase was determined by trial and error, as it became evident that the martensitic transformation temperature for these alloys was not as would be expected from the equilibrium phase diagram. The flat shape of the article was thus established as a first configuration at a first temperature above the martensitic transformation temperature. The strips were then cooled back down to 25° C. and deformed into a ring shape. The ring shape was thus established as a second configuration at a second temperature below the martensitic transformation temperature. The ring shapes were then heated toward 140° C. As the rings were heated, shape recovery toward the original flat strip configuration was observed above 25° C. for the alloys of the invention containing 21–28at.% thallium (Examples 5–11).

Indium-thallium alloys of the invention having thallium content greater than 28 at.% will exhibit shape memory transformation at temperatures less than 25° C. These alloys contain a significant amount of parent phase at 25° C. and therefore do not need to be heated above that temperature in order to attain a parent phase content sufficient to "remember". An article having a first configuration constructed of one of these alloys may be cooled, as by quenching, for example, to a temperature below its martensitic temperature and then deformed into a second configuration. Upon warming back up to a temperature above the martensitic transformation temperature, the article will experience shape recovery toward its first configuration.

EXAMPLE 18

Approximately 250 ml of a synthetic electrolyte having a pH of about 0.95 was prepared by dissolving 52.0 g/l indium sulfate, 10.0 g/l sodium sulfate and 2.0 g/l cadmium sulfate in a sulfuric acid solution. A glassy carbon plate with a surface area of 3cm$^2$ on one side was cleaned ultrasonically in a micro-detergent solution, rinsed with deionized water and provided as the cathode. A piece of platinum foil with a one-sided surface area of 4cm$^2$ was provided as the anode. DC current was provided to the electrolyte. The electrolyte was not agitated. A deposit which was 50+/−10 microns thick was removed from the cathode by peeling.

TABLE 2

| Ex. # | At. % Cd | Peak Current Density MA/cm$^2$ | On/Off Time MSEC | Duty Cycle % | Total Current amp-hrs | Electrolyte Temperature °C. |
|---|---|---|---|---|---|---|
| 18 | 5.0 | 70.0 | — | 100% | 0.105 | 25 |

By processing certain indium-cadmium alloys according to the method of the invention, the martensitic transformation temperature is shifted to the left vis a vis its position on the indium-cadmium equilibrium phase diagram. An indium-cadmium alloy of a given composition therefore exhibits martensitic transformation at a lower temperature if processed by the method of the invention than if processed thermally.

In view of the above, it will be seen that the several objects of the invention are achieved.

Although specific examples of the present invention and its application are set forth herein, it is not intended that they are exhaustive or limiting of the invention. These illustrations and explanations are intended to acquaint others skilled in the art with the invention, its principles, and its practical application, so that others skilled in the art may adapt and apply the invention in its numerous forms, as may be best suited to the requirements of a particular use.

What is claimed is:

1. A process for preparing an indium-thallium alloy which exhibits shape memory transformation at a temperature greater than that temperature at which shape memory transformation would occur for a thermally prepared alloy of the same composition, the process comprising:

providing an article for use as a cathode;

providing an electrolyte by dissolving indium sulfate and thallium sulfate in an acidic solution;

electrodepositing the indium-thallium alloy onto the article, the indium-thallium alloy comprising between about 21 and about 35 atomic percent thallium.

2. A process as set forth in claim 1 wherein said article for use as a cathode has a generally rectangular conformation.

3. A process as set forth in claim 1 wherein said article for use as a cathode is a polyhedral body.

4. A process as set forth in claim 1 wherein said article for use as a cathode is an electronic circuit.

5. A process as set forth in claim 1 wherein said electrolyte is prepared by dissolving, in a sulfuric acid solution, indium sulfate in the range of from about 30 g/l to about 50 g/l and thallium sulfate in the range of from about 1.0 g/l to about 3.0 g/l.

6. A process as set forth in claim 1 wherein said electrolyte is maintained in the range of from about 20° C. to about 50° C.

7. A process as set forth in claim 1 wherein said indium-thallium alloy comprises between about 23 and about 28 atomic percent thallium.

8. A process for preparing an article constructed of an electrodeposited indium-thallium alloy which exhibits shape memory effect, the process comprising:

providing an electrodeposited indium-thallium alloy having between about 21 and about 35 atomic percent thallium, said alloy exhibiting shape memory transformation at a temperature greater than that at which shape memory transformation would occur for a thermally prepared alloy of the same composition;

establishing a first configuration of the article at a first higher temperature, said first higher temperature being a temperature greater than the martensitic transformation temperature for the alloy;

establishing a second configuration by deforming the article at a second lower temperature, said second lower temperature being a temperature less than the martensitic transformation temperature for the alloy.

9. A process as set forth in claim 8 wherein said second lower temperature is between about 5° C. and about 30° C.

10. A process as set forth in claim 8 wherein said second lower temperature is between about −50° C. and about 5° C.

11. A process for preparing an indium-thallium alloy which exhibits shape memory transformation at a temperature greater than that temperature at which shape memory transformation would occur for a thermally prepared alloy of the same composition, the process comprising:

providing an article for use as a cathode;

providing an electrolyte which comprises indium and thallium ions;

electrodepositing the indium-thallium alloy onto the article by providing pulsed current to the electrolyte, the indium-thallium alloy comprising between about 21 and about 35 atomic percent thallium.

12. A process as set forth in claim 11 wherein said pulsed current has a peak current density of between about 6 and about 40 $mA/cm^2$.

13. A process as set forth in claim 11 wherein said pulsed current has a duty cycle of between about 30% and about 70%.

14. A process as set forth in claim 11 wherein said indium-thallium alloy comprises between about 23 and 28 atomic percent thallium.

* * * * *